US011456133B2

(12) United States Patent
Benkert et al.

(10) Patent No.: US 11,456,133 B2
(45) Date of Patent: Sep. 27, 2022

(54) VACUUM INTERRUPTER AND HIGH-VOLTAGE SWITCHING ASSEMBLY

(71) Applicant: SIEMENS ENERGY GLOBAL GMBH & CO. KG, Munich (DE)

(72) Inventors: Katrin Benkert, Schwaig (DE); Martin Koletzko, Baiersdorf ot Igelsdorf (DE); Paul Gregor Nikolic, Erlangen (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/264,932

(22) PCT Filed: Jul. 24, 2019

(86) PCT No.: PCT/EP2019/069868

§ 371 (c)(1),
(2) Date: Feb. 1, 2021

(87) PCT Pub. No.: WO2020/025407

PCT Pub. Date: Feb. 6, 2020

(65) Prior Publication Data

US 2021/0327666 A1 Oct. 21, 2021

(30) Foreign Application Priority Data

Aug. 1, 2018 (DE) ..... 102018212853.7

(51) Int. Cl.
*H01H 1/02* (2006.01)
*H01H 33/662* (2006.01)

(52) U.S. Cl.
CPC .... *H01H 33/66207* (2013.01); *H01H 1/0203* (2013.01); *H01H 33/66261* (2013.01); *H01H 2033/6623* (2013.01)

(58) Field of Classification Search
CPC ..... H01H 33/66207; H01H 33/66261; H01H 2033/6623; H01H 2033/66284; H01H 1/0203; H01H 33/596
(Continued)

(56) References Cited

U.S. PATENT DOCUMENTS 3,411,038 A * 11/1968 Lee ..... H01H 33/66 361/12
4,010,338 A * 3/1977 Amsler ..... H01H 33/6646 218/126

(Continued)

FOREIGN PATENT DOCUMENTS

DE 4447391 C1 6/1996
EP 1858044 A2 11/2007

(Continued)

OTHER PUBLICATIONS

Translation of DE4447391 (Original document published Jun. 5, 1996) (Year: 1996).*

(Continued)

*Primary Examiner* — William A Bolton
(74) *Attorney, Agent, or Firm* — Laurence A Greenberg; Werner H Stemer; Ralph E Locher

(57) ABSTRACT

A vacuum interrupter includes a housing having at least one annular ceramic insulating element which forms a vacuum chamber. A contact system has two contacts which are movable relative to one another. A capacitive element has two electrodes and a dielectric material disposed between the electrodes. The capacitive element is form-lockingly mounted on the insulating element and has a capacitance between 400 pF and 4000 pF. A high-voltage switching assembly including the vacuum interrupter is also provided.

16 Claims, 6 Drawing Sheets

(58) Field of Classification Search
USPC ..... 218/134, 139, 143, 144, 145
See application file for complete search history.

(56) References Cited

U.S. PATENT DOCUMENTS

| | | | | |
|---|---|---|---|---|
| 4,027,123 | A * | 5/1977 | Ihara | H01H 33/14 218/4 |
| 4,434,332 | A * | 2/1984 | Yanabu | H01H 33/143 218/144 |
| 8,497,446 | B1 * | 7/2013 | Glaser | H01H 33/143 218/136 |
| 10,453,633 | B2 | 10/2019 | Wang | |
| 10,685,797 | B2 | 6/2020 | Hartmann et al. | |
| 2013/0062316 | A1 * | 3/2013 | Renz | H01H 33/66261 218/139 |
| 2017/0186574 | A1 * | 6/2017 | Gentsch | H01H 33/664 |
| 2017/0200572 | A1 * | 7/2017 | Vinson | H01H 33/668 |
| 2019/0051474 | A1 | 2/2019 | Suwa | |

FOREIGN PATENT DOCUMENTS

| | | | |
|---|---|---|---|
| FR | 2971884 | A1 | 8/2012 |
| JP | S52142658 | U | 10/1977 |
| JP | 4481808 | B2 | 6/2010 |
| JP | 2017157453 | A | 9/2017 |
| WO | 2017067494 | A1 | 4/2017 |
| WO | 2018028946 | A1 | 2/2018 |

OTHER PUBLICATIONS

Translation of FR2971884 (Original document published Aug. 24, 2012) (Year: 2012).*

* cited by examiner

VACUUM INTERRUPTER AND HIGH-VOLTAGE SWITCHING ASSEMBLY

BACKGROUND OF THE INVENTION

Field of the Invention

The invention relates to a vacuum interrupter according to the introductory including a housing having at least one annular ceramic insulating element which constitutes a vacuum chamber, and a contact system having two contacts which are moveable relative to one another. The invention also relates to a high-voltage switching assembly including a vacuum interrupter according to the invention.

In high-voltage or extra high-voltage transmission systems, gas or vacuum circuit-breakers are employed for the interruption of operating currents and fault currents. For the fulfilment of voltage requirements, particularly in transmission systems which have a rated voltage in excess of 380 kV, power interrupter chambers are connected in series, in order to ensure compliance with standard specifications for power values. In order to prevent the overloading of an individual power interrupter chamber in this series-connected arrangement, control of voltage division is required. In general, voltages are divided over the individual elements of power interrupter chambers to a respective proportion of 50%. To this end, according to the prior art, control elements are connected in parallel with the individual power interrupter chambers. A control element of this type is generally a capacitor, or a capacitor and a resistor connected in series. Control elements of this type require additional structural space, and must be fitted in an insulated arrangement, thereby overall resulting in a high, and correspondingly cost-intensive degree of technical complexity.

SUMMARY OF THE INVENTION

The object of the invention is thus the provision of a vacuum interrupter for high-voltage applications, and of a high-voltage switching assembly which, in comparison with the prior art, features a lower degree of technical complexity for the provision of control elements.

This object is fulfilled by a vacuum interrupter and by a high-voltage switching assembly having the features described below.

The vacuum interrupter according to the invention, comprises a housing having at least one annular ceramic insulating element, which constitutes a vacuum chamber. The vacuum interrupter further comprises a contact system, having two contacts which are moveable relative to one another. The vacuum interrupter is characterized in that a capacitive element having two electrodes is provided, together with a dielectric material which is disposed between the electrodes, wherein the capacitive element is form-lockingly mounted on the insulating element, and has a capacitance between 400 pF and 4000 pF.

The vacuum interrupter according to the invention has an advantage over the prior art, in that the requisite control element for the division of voltage between the individual power interrupter chambers is integrated in the vacuum interrupter, and specifically on the surface of the insulating element. This results in a saving of production costs, the reduction of technical complexity associated with the provision of the vacuum interrupter, and the avoidance of installation costs.

In one configuration of the invention, in addition to the capacitive element, i.e. the capacitor, a resistive element, i.e. a resistor, which is likewise integrated in at least one insulating element, is further provided. This can apply particularly to a series-connected arrangement of a resistive element and a capacitive element, or to a series circuit of these two elements.

In particular, the dielectric material of the capacitive element is applied in a layered arrangement to one surface of the insulating element. In principle, although both the inner and the outer surface of the insulating element are appropriate for this purpose, the application of the resistive element to the outer surface provides an advantage, in that a wider choice of materials are available, e.g. a ferroelectric material embedded in an epoxy resin matrix, whereas the inner surface is subject to highly specific requirements, with respect to the outgassing behavior of materials.

The resistance of the resistive element preferably has a value which lies between 100 ohms and 1500 ohms, or between $10^8$ and $10^{15}$ ohms.

The dielectric material is preferably applied to the surface of the insulating element in the form of a layer, wherein the layer has a thickness ranging from 5 μm to 150 μm, or from 1 mm to 5 mm. The associated electrodes, with respect to an extension of the insulating element along a switching axis, are arranged on one upper and one lower end face. It is appropriate if the electrodes are integrated in soldered connections between insulating elements. Electrodes can easily be applied to these end faces and, between the electrodes, the dielectric material can be applied to the outer surface of the insulating element, and thus contact-connected. Integration of the electrodes in soldered connections is appropriate, but is not essential. The soldered connection itself can also function as an electrode.

Alternatively or additionally, it is also appropriate that the electrodes, in the form of a layer or winding, are arranged on the outer surface of the insulating element such that, on the latter, in turn, the dielectric material is arranged in a second layer or a second winding, such that the capacitive element is constituted on the outer surface of the insulating material in an alternating layered arrangement of the electrode and the dielectric material.

In principle, a material having a high dielectric constant is appropriate as a dielectric material, particularly a ferroelectric material, wherein a titanate is particularly appropriate, and wherein barium titanate is particularly preferred.

A further configuration of the invention is a high-voltage switching assembly which comprises a vacuum interrupter according to the invention, and which additionally comprises a further interrupter unit which is connected in series thereto. This is a high-voltage switching assembly which, in principle, is known from the prior art, but which comprises at least one vacuum interrupter according to the invention by way of a series-connected interrupter unit such that, in the high-voltage switching assembly described, the corresponding control elements, particularly capacitively acting capacitors, can be omitted. Preferably, one of the two interrupter units is the vacuum interrupter described, and a second interrupter unit is a gas-insulated switch. If a gas-insulated switch is employed, a parallel connection of conventional control elements with the gas-insulated switch is required.

Further forms of embodiment and further features of the invention proceed from the following description of the figures. Features having the same designation, but in different forms of embodiment, are identified by the same reference symbols. These are purely schematic forms of embodiment, which are of an exemplary nature, and do not constitute any limitation of the scope of protection.

DETAILED DESCRIPTION OF THE INVENTION

Figure 1:
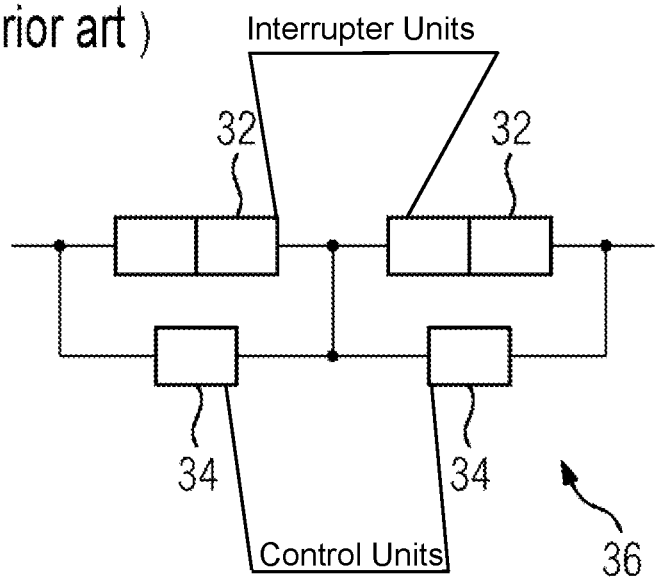
FIG 1 ( Prior art )
FIG. 1 shows an equivalent circuit diagram of a high-voltage switching assembly according to the prior art, having parallel-connected control elements.

FIG. 1 shows a series-connected arrangement of two interrupter units 32 according to the prior art. Although these interrupter units 32 can be gas-insulated switches, they can also be vacuum interrupters. Control elements 34 are interconnected in parallel with the series-connected interrupter units 32, in order to protect the individual interrupter units 32 in this series-connected arrangement against overloading. To this end, resistors or capacitors are employed, which can be connected in parallel, but also in series. Voltages are thus divided between the individual interrupter units 32, and any overload is prevented.

Figure 2:
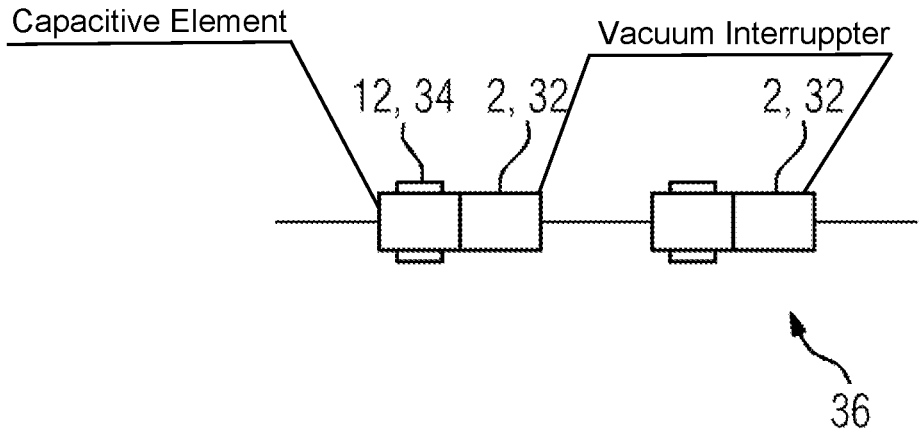
FIG. 2 shows a high-voltage switching assembly having two series-connected interrupter units, which incorporate integrated control elements.

FIG. 2 represents a configuration in which an interrupter unit 32, in the form of a vacuum interrupter 2, is connected in series with a further interrupter unit 32. The vacuum interrupter 2 incorporates control elements 34, which are configured in the form of capacitive elements 12 and are integrated in the vacuum interrupter 2, as described in greater detail with reference to FIG. 3.

Figure 3:
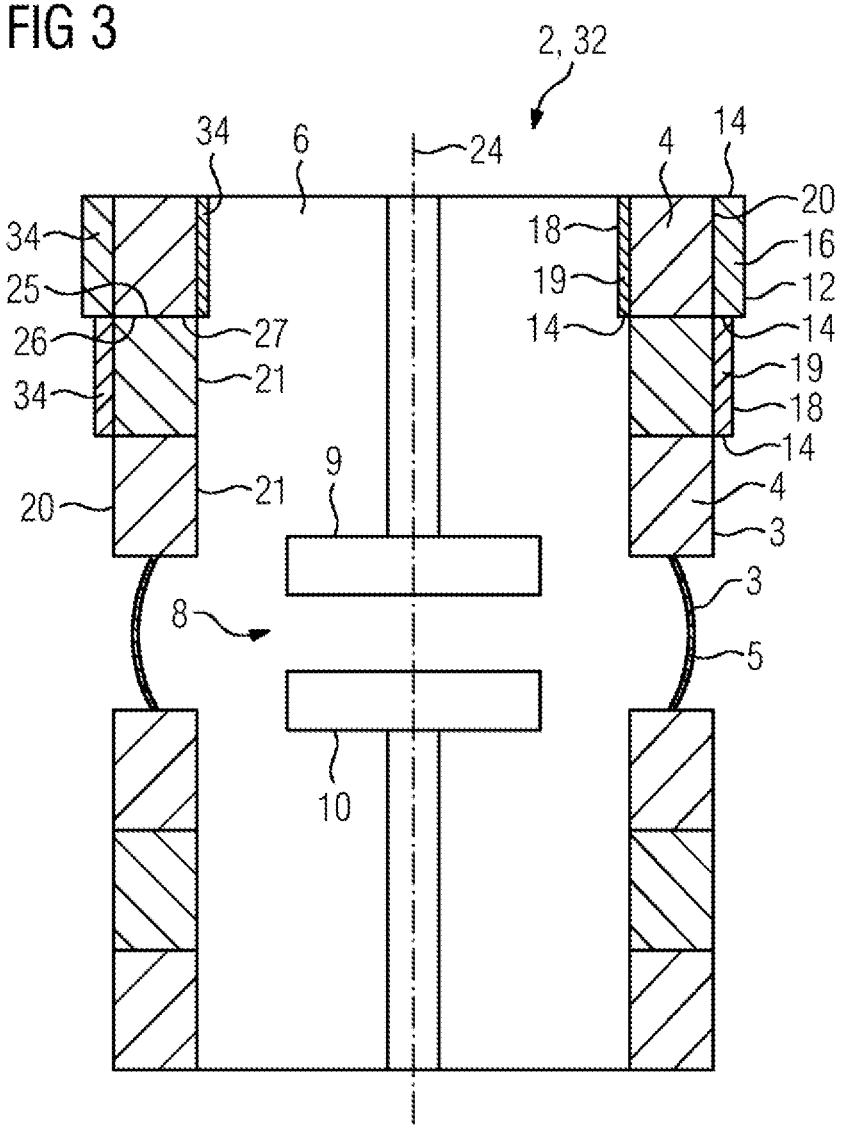
FIG. 3 shows a cross-sectional view of a vacuum interrupter having resistive and capacitive control elements which are integrated on the surfaces of insulating elements.

FIG. 3 shows a cross-sectional view of a vacuum interrupter 2 having a housing 3, wherein the housing 3 incorporates a plurality of insulating elements 4 and a centrally arranged metal shield 5. The metal shield 5 is arranged in the housing 3 such that it is mounted in the position in which the contacts 9 and 10 which, in combination, constitute a contact system 8, are mounted in a moveable arrangement along a switching axis 24.

The insulating elements 4 are essentially cylindrically configured, and are also stacked one on top of another along the switching axis 24 such that, along this switching axis 24, which also constitutes the cylinder axis, they constitute a cylinder. The individual insulating elements 4 are connected in a mutually form-locking manner wherein, in the majority of cases, a soldered connection is prevalent. The housing 3 which encloses the contact system 8 constitutes a vacuum chamber 8 which, overall, is sealed vis-à-vis the atmosphere in a vacuum-tight manner.

In schematic terms, a conventional vacuum interrupter 2 according to the prior art is thus constituted. The present vacuum interrupter 2 differs from the latter, in that control elements 34 are arranged on surfaces 20, 21 of the insulating elements 4, wherein at least one capacitive element 12 is fitted to a surface 20, 21 of the insulating element 4. It is not necessary for an explicit distinction to be drawn between an inner surface 21 and an outer surface 20 of the insulating element, wherein, in many cases, it is appropriate for the capacitive element 12 to be fitted to the outer surface 20 of the insulating element 4.

Electrodes 14 are provided, which are preferably arranged between end faces 25 and 26 of the insulating elements 4, along the switching axis 24. The electrodes 14 can be extensions of soldering surfaces 27, which are employed for the connection of the individual insulating elements 4. The electrodes 14, considered radially to the axis 24, thus project to a degree beyond the respective end faces 25 and 26 of the insulating elements 4 such that, between these projecting overhangs of the electrodes 14, a dielectric material 16 is arranged on the outer surface 20 of the insulating element 4, which is contact-connected with the electrodes 14. The electrodes 14, which are contact-connected with the dielectric material 16, constitute the capacitive element 12, in combination with the latter.

Figure 4:
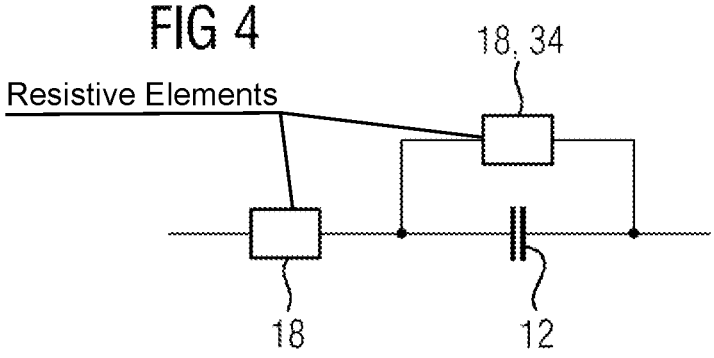
FIG. 4 shows an equivalent circuit diagram of the assembly of capacitive and resistive elements for the vacuum interrupter according to FIG. 3.

It is moreover appropriate that, between electrodes 14 of essentially identical design, a resistive material 19 is also arranged, and is contact-connected with the latter. The resistive element 18 is thus constituted in combination with the electrodes. In the representation according to FIG. 3, on the outer surface 20 of the uppermost insulating element 4, a capacitive element is arranged, which is connected by means of the same electrodes 14 as the resistive element on the inner side of the insulating element 4. A parallel-connected arrangement of the two control elements 34 is thus constituted. In combination with a further resistive element 18 on the adjoining insulating element 4 in FIG. 3, the equivalent circuit diagram according to FIG. 4 is constituted accordingly.

As a material for the capacitive element 12, i.e. the dielectric material 16, for the setting of the desired capacitance, a material having a high $\varepsilon_r$, i.e. a high dielectric constant, is preferably employed. Ferro-electric materials are appropriate for this purpose, particularly a titanate, wherein the employment of barium titanate ($\varepsilon_r$=1000) is preferred. In order to achieve a corresponding capacitance of 400 pF to 4000 pF, the dielectric material can contain the barium titanate in concentrations which, at a specified film thickness of the dielectric material 16 on the insulating element 4, result in the desired capacitance. In particular, a dielectric material is advantageous, in which the barium titanate is embedded in an epoxy resin matrix. The film thickness of the dielectric material 16 of the capacitive element 12 generally lies within the range of 5 μm to 150 μm, rather than the range of 1 mm to 5 mm.

Figure 5:
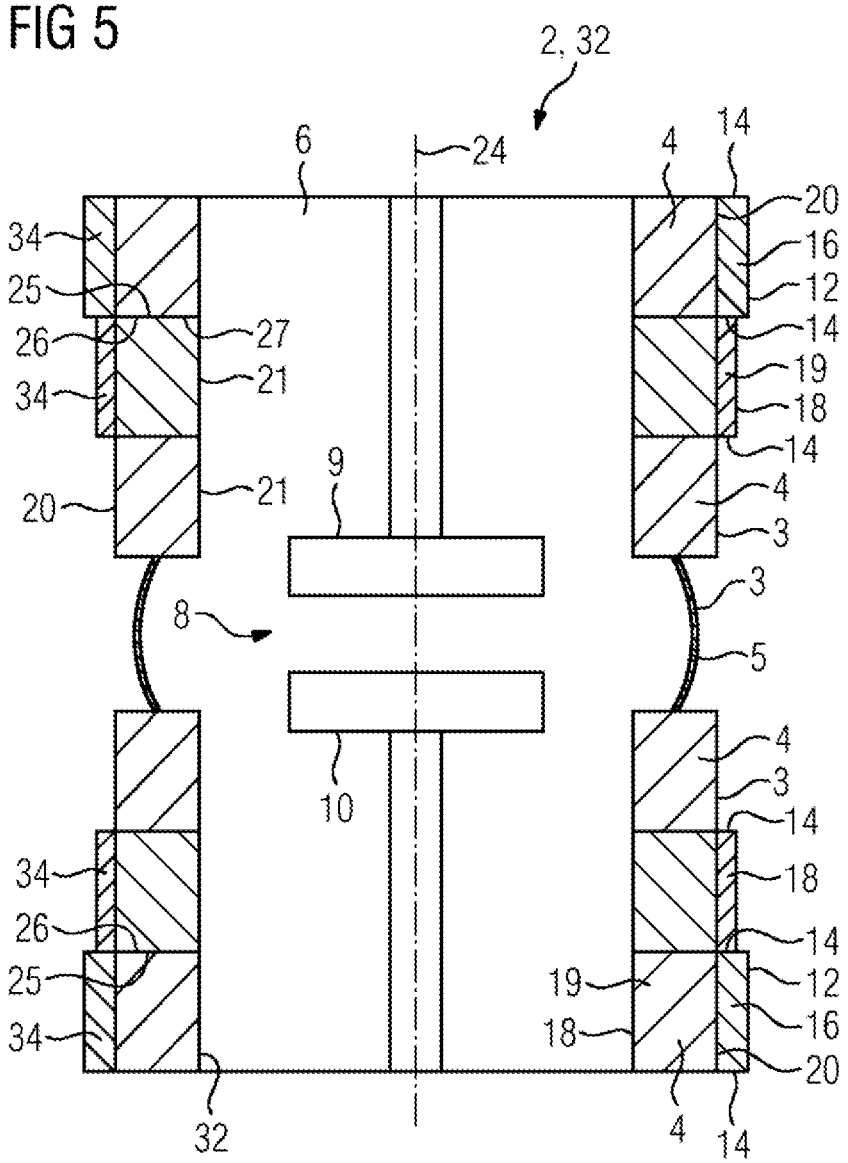
FIG. 5 shows a cross-sectional view of a vacuum interrupter according to FIG. 1, having control elements in the upper and lower region of the vacuum interrupter.
Figure 6:
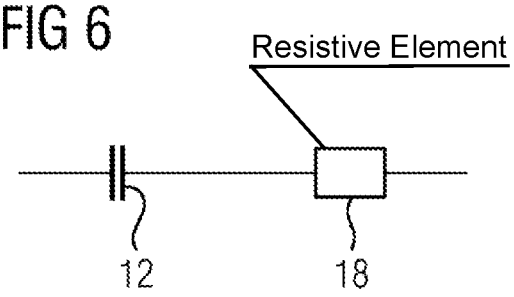
FIG. 6 shows an equivalent circuit diagram of control elements for the vacuum interrupter according to FIG. 5.

FIG. 5 shows a representation of the vacuum interrupter 2 according to FIG. 1, wherein the arrangement of control elements 32 is symmetrically distributed over the housing 3 or over the insulating elements 4 with respect to the housing 3. This permits a targeted voltage division along the housing 3, between the various insulating elements 4. This involves a series-connected arrangement of a capacitive element 12 and a resistive element 18, as reproduced in the equivalent circuit diagram according to FIG. 6.

Figure 7:
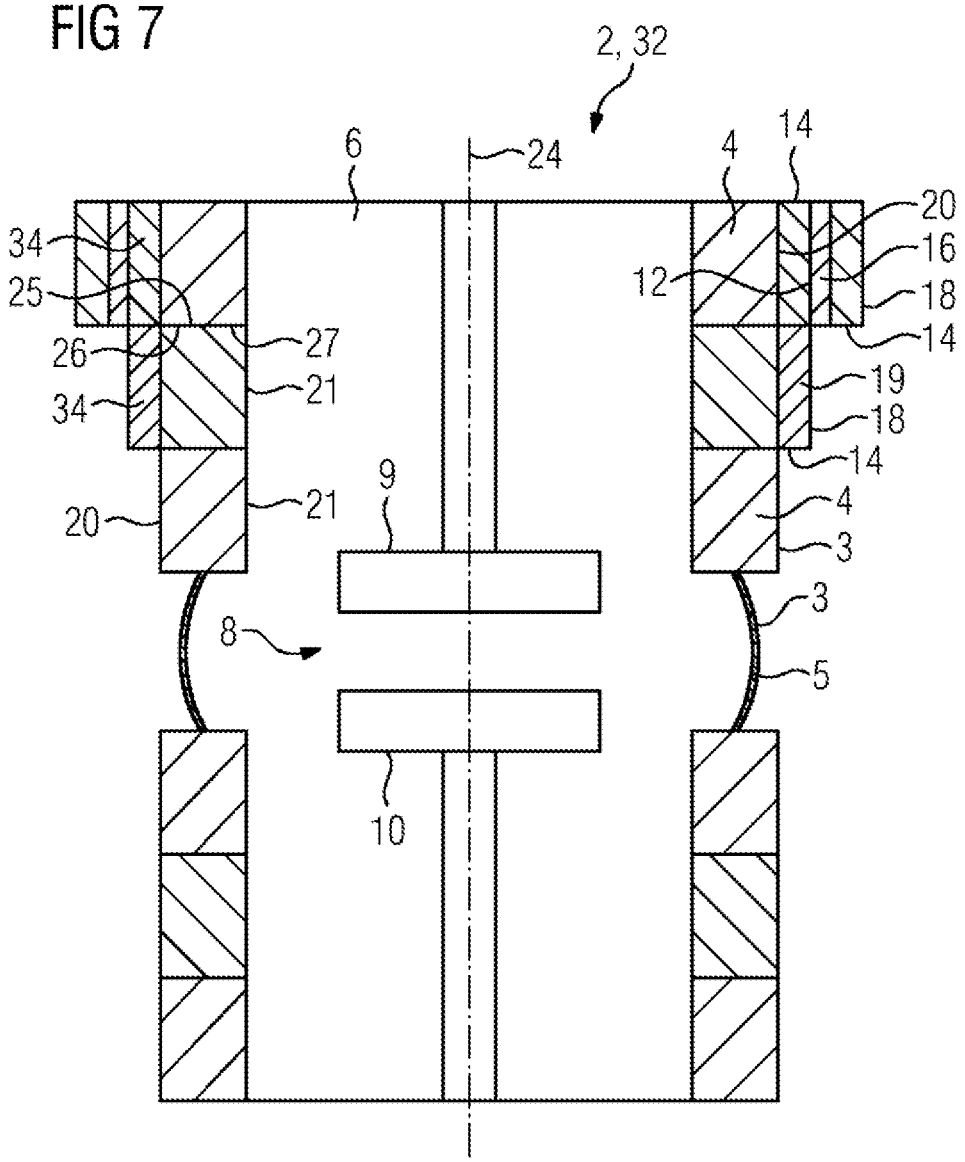
FIG. 7 shows a vacuum interrupter according to FIG. 1, having control elements according to the equivalent circuit diagram shown in FIG. 8.
Figure 8:
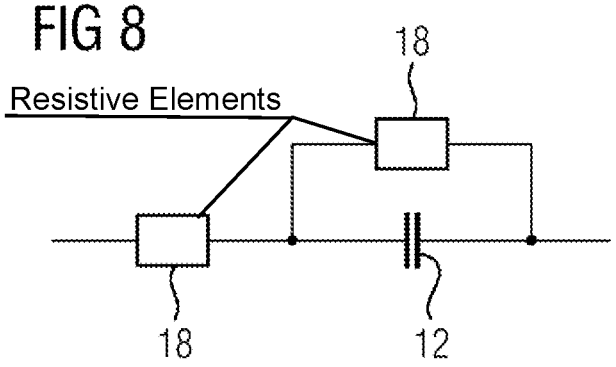
FIG. 8 shows an equivalent circuit diagram of control elements for the vacuum interrupter according to FIG. 7.

FIG. 7 also represents a vacuum interrupter 2 according to FIG. 1, wherein both a capacitive element 12 and a resistive element 18 are fitted to the outer surface 20 of the insulating element 4. Considered in a radial direction, the dielectrically acting material 16 is thus arranged towards the interior, followed by an insulator, which is not described in greater detail here, and thereafter by the resistive material 19. Both the dielectric material 16 and the resistive material 19 are connected to the electrodes 14, according to the equivalent circuit diagram represented in FIG. 8, in a parallel-connected arrangement. On the next insulating element 4 in sequence, a further resistive element 18, as described above, is fitted, such that a further resistive element 18 is connected in series with the parallel-connected arrangement of the resistive element 18 and the capacitive element 12, as represented in FIG. 8 in the form of an equivalent circuit diagram. This circuit arrangement, in an analogous manner to FIG. 5, can also be symmetrically repeated in the lower region of the housing 3. In principle, the representation and the arrangement of resistive or capacitive elements 12, 18 constitute exemplary forms of embodiment. They could also be arranged on all the other insulating elements 4. Thus, in a manner which applies correspondingly to FIGS. 3, 5, 7 and 9, all the control elements 34 can be fitted to either an inner surface 21 or an outer surface 20 of the insulating elements 4.

Figure 9:
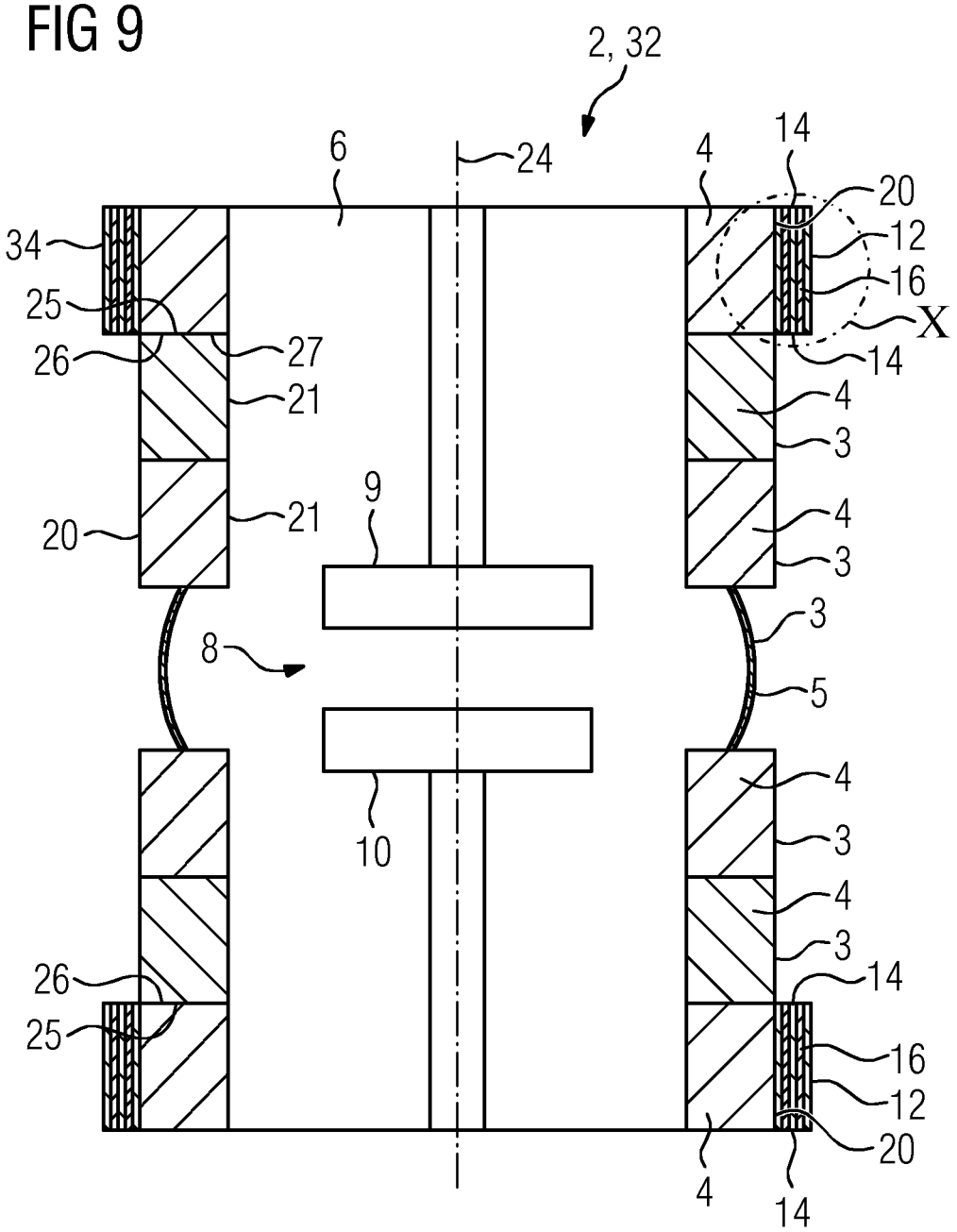
FIG. 9 shows a vacuum interrupter according to FIG. 1, wherein the capacitive element is applied to the insulating element in the form of an alternating layer.
Figure 10:
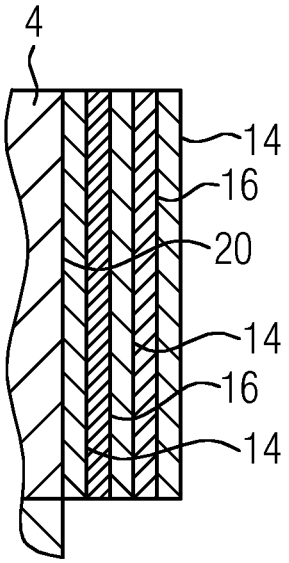
FIG. 10 shows an enlarged section of the layered sequence, from section X in FIG. 9.
Figure 11:
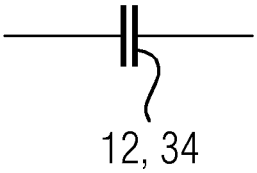
FIG. 11 shows an equivalent circuit diagram of the control element, according to the vacuum interrupter shown in FIG. 9.

FIG. 9 represents an alternative configuration of the capacitive element 12. Alternating layers of the electrode 14 and the dielectric material 16 are radially wound about the outer surface 20 of the insulating element 4. An enlarged representation of section X in FIG. 9 is shown in FIG. 10. The sequential layers of the electrode 14 and the dielectric material 16 on the outer surface 20 can be seen here. A dielectric material 16 is thus embedded, on either side, in a layer of conductive electrode material, in the form of the electrode 14. In this manner, the correspondingly desired capacitances of the control element 34 can be more accurately set by the number of individual layers. The corresponding equivalent circuit diagram is represented in FIG. 11. In this case, for exemplary purposes only, one capacitance or one capacitive element 12 is represented. The vacuum interrupter represented in FIG. 9 can also be fitted with further control elements, as represented in FIGS. 3, 5 and 7, in any combination required, both internally and externally.

LIST OF REFERENCE NUMBERS

2 Vacuum interrupter
3 Housing
4 Insulating element
5 Metal shield
6 Vacuum chamber
8 Contact system
9 Moveable contact
10 Fixed contact
12 Capacitive element
14 Electrodes
16 Dielectric material
18 Resistive element
19 Resistive material
20 Outer surface of insulating element
21 Inner surface
22 Layer of dielectric material
24 Switching axis
25 Upper end face
26 Lower end face
27 Soldering surfaces
28 Switching assembly
32 Interrupter unit
34 Control element
36 Series-connected arrangement of power interrupter chambers

The invention claimed is:

1. A vacuum interrupter, comprising:

a housing having at least one annular ceramic insulating element forming a vacuum chamber;

a contact system having two contacts being moveable relative to one another;

a capacitive element having two electrodes and a dielectric material disposed between said electrodes, said capacitive element being form-lockingly mounted on said insulating element, and said capacitive element having a capacitance of between 400 pF and 4000 pF; and a resistive element disposed on said at least one insulating element in addition to said capacitive element.

2. The vacuum interrupter according to claim 1, wherein said at least one insulating element has a surface, said capacitive element includes a dielectric material, and at least said dielectric material is applied in a layered configuration to said surface of said at least one insulating element.

3. The vacuum interrupter according to claim 1, wherein said at least one insulating element has an outer surface, and said capacitive element is disposed on said outer surface of said at least one insulating element.

4. The vacuum interrupter according to claim 1, wherein said capacitive element and said resistive element are connected in series.

5. The vacuum interrupter according to claim 1, wherein said resistive element is form-lockingly connected to said at least one insulating element.

6. The vacuum interrupter according to claim 1, wherein said resistive element has a resistance of between 100 ohms and 1500 ohms.

7. The vacuum interrupter according to claim 1, wherein said resistive element has a resistance of between $10^8$ and $10^{15}$ ohms.

8. The vacuum interrupter according to claim 1, wherein said at least one insulating element has a surface, said dielectric material is applied to said surface of said at least one insulating element as a layer, and said layer has a thickness of from 5 μm to 150 μm.

9. The vacuum interrupter according to claim 1, wherein said at least one insulating element has a surface, said dielectric material is applied to said surface of said at least one insulating element as a layer, and said layer has a thickness of from 1 mm to 5 mm.

10. The vacuum interrupter according to claim 1, wherein said at least one insulating element has one upper and one lower end face relative to an extension of said at least one insulating element along a switching axis, and said electrodes are disposed on said one upper and said one lower end face of said at least one insulating element.

11. The vacuum interrupter according to claim 10, wherein said at least one insulating element includes a plurality of insulating elements, and said electrodes are integrated in soldered connections between said insulating elements.

12. The vacuum interrupter according to claim 1, wherein said at least one insulating element has an outer surface, and one of said electrodes is applied to said outer surface of said at least one insulating element as a layer.

13. The vacuum interrupter according to claim 12, wherein said capacitive element is disposed on said outer surface of said at least one insulating element in an alternating layered configuration of one of said electrodes, said dielectric material and another of said electrodes.

14. The vacuum interrupter according to claim 1, wherein said dielectric material contains a ferro-electric material, titanate or barium titanate.

15. A high-voltage switching assembly, comprising:

the vacuum interrupter according to claim 1; and a further interrupter unit connected in series with said vacuum interrupter.

16. The high-voltage switching assembly according to claim 15, wherein said further interrupter unit is a vacuum interrupter or a gas-insulated switch.

* * * * *